US006753855B2

(12) United States Patent
Yu

(10) Patent No.: US 6,753,855 B2
(45) Date of Patent: Jun. 22, 2004

(54) DRIVER CIRCUIT FOR LCDM

(75) Inventor: William Yu, Taipei (TW)

(73) Assignee: Inventec Corporation, Taipei (TW)

( * ) Notice: Subject to any disclaimer, the term of this patent is extended or adjusted under 35 U.S.C. 154(b) by 230 days.

(21) Appl. No.: 10/056,480

(22) Filed: Jan. 28, 2002

(65) Prior Publication Data

US 2003/0142083 A1 Jul. 31, 2003

(51) Int. Cl.[7] ..... G09G 5/00
(52) U.S. Cl. ..... 345/204
(58) Field of Search ..... 345/204, 74.1, 345/75.1, 70, 205, 87, 90, 95, 92, 55, 63, 102; 315/219, 354; 349/61, 70, 71

(56) References Cited

U.S. PATENT DOCUMENTS 6,016,052 A * 1/2000 Vaughn ..... 323/355
6,225,751 B1 * 5/2001 Komatsu ..... 315/209 R
6,307,765 B1 * 10/2001 Choi ..... 363/134
6,469,922 B2 * 10/2002 Choi ..... 363/134
6,566,821 B2 * 5/2003 Nakatsuka et al. ... 315/209 PZ
6,639,366 B2 * 10/2003 Bai ..... 315/219
2003/0058670 A1 * 3/2003 Choi ..... 363/127
2003/0179168 A1 * 9/2003 Rosenberg et al. ..... 345/87

* cited by examiner

*Primary Examiner*—Richard Hjerpe
*Assistant Examiner*—Ronald Laneau
(74) *Attorney, Agent, or Firm*—Birch, Stewart, Kolasch & Birch, LLP

(57) ABSTRACT

A driver circuit of an LCDM is disclosed. The driver circuit contains a driving unit and a transformer unit. When the LCDM needs to drive a plurality of inverters, the driving unit sends out a driving voltage in an asynchronous way to drive the transformer unit. The transformer unit amplifies the driving voltage and sends it to the lamps. The invention thus achieves the goal of driving the LCDM using different timings within a work period.

8 Claims, 3 Drawing Sheets

DRIVER CIRCUIT FOR LCDM

BACKGROUND OF THE INVENTION

1. Field of Invention

The invention relates to a driver circuit and, in particular, to a driver circuit for LCDM's (liquid crystal display module).

2. Related Art

With the advance and popularity of the electronic technology, peripheral devices of information processing apparatus also make continuous progress along with the stronger functions provided by the information processing apparatus. Taking display devices as an example, the conventional display device uses a filament to heat up a cathode to emit electrons. Through acceleration and convergence, the electrons form a beam and hit a fluorescent screen, producing light spots or electrical signals. This is the CRT (cathode ray tube) monitor. Nowadays, a popular display device is the LCDM (liquid crystal display module), which uses rod-shaped crystal molecules that change directions through the action of currents to display information.

Commonly seen LCDM can be classified into TN—LCD (twisted nematic—LCD), STN—LCD (super TN—LCD), DSTN—LCD (double layer STN—LCD), and TFT—LCD (thin film transistor—LCD). However, when the LCDM is working, it often needs to drive a plurality of inverters within the same work period to maintain the functioning of several sets of CCFL's (cold cathode fluorescent lamp). However, the power consumed by the LCDM is also multiply increased.

It is thus highly desirable to be able to simultaneously drive a plurality of sets of inverters to maintain the proper functioning of several sets of CCFL's while lowering the power consumption at the same time.

SUMMARY OF THE INVENTION

In view of the foregoing, the invention provides a driver circuit of the LCDM. An objective of the invention is to lower the power consumption of the LCDM during work. The driver circuit of the LCDM includes a driving unit and a transformer unit. When the LCDM needs to drive a plurality of sets of inverters, the driving unit sends out a driving voltage in an asynchronous way to drive the transformer unit. The transformer unit then amplifies the driving voltage and sends it to the lamps. The invention thus achieves the goal of driving the LCDM using different timings within a work period.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
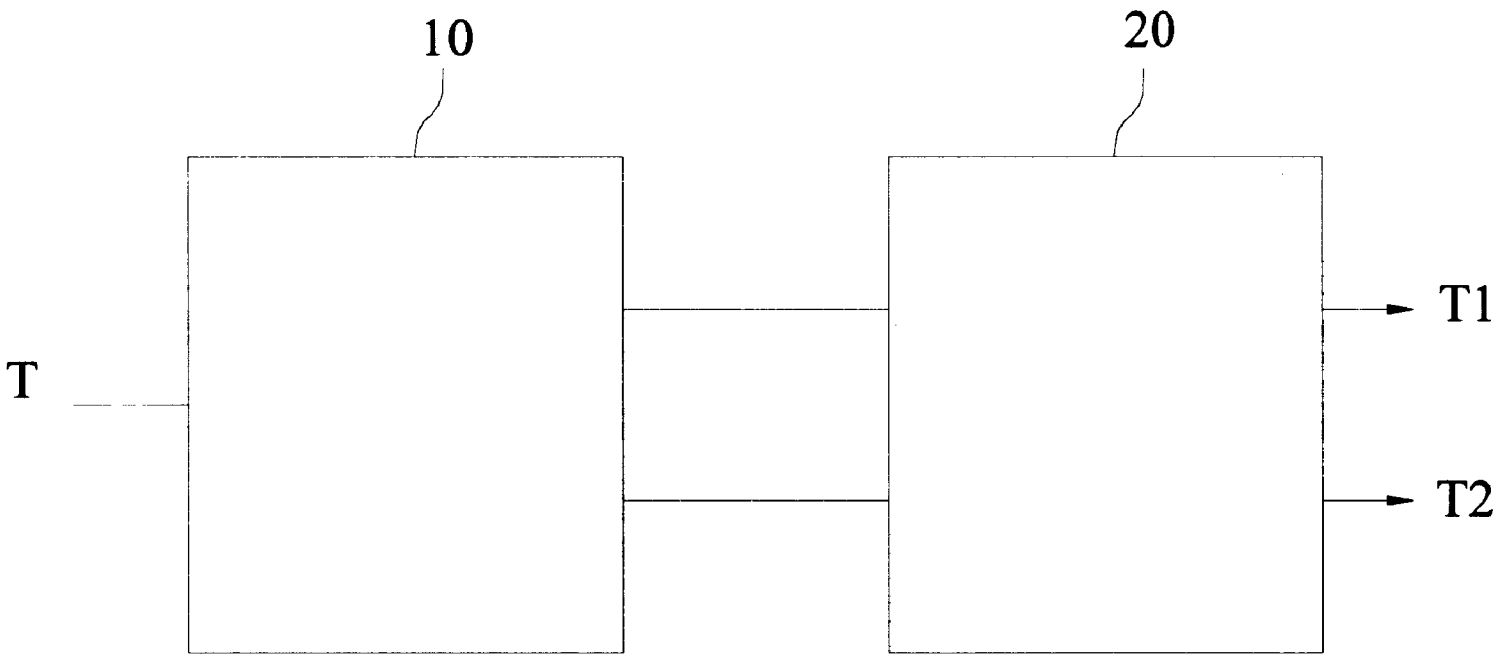
FIG. 1 is a schematic system block diagram of the disclosed driver circuit.

The invention is a driver circuit for LCDM's (liquid crystal display module). With reference to FIG. 1, the disclosed driver circuit is a driver circuit that drives multiple sets of lamps in an asynchronous way. The lamp is a CCFL (cold cathode fluorescent lamp) of the LCDM. The driver circuit of the LCDM includes at least a driving unit 10 and a transformer unit 20. The driving unit 10 receives a work period T, which is the work period of a CCFL of the LCDM. When the driving unit 10 performs operations on the work period T after receiving it. The driving unit 10 then generates a plurality of driving voltages in an asynchronous way. These driving voltages are then sent to the transformer unit 20 within the work period T. The transformer unit 20 then amplifies and converts the driving voltages and sends them to the CCFL's of the LCDM for its functioning.

Figure 2:
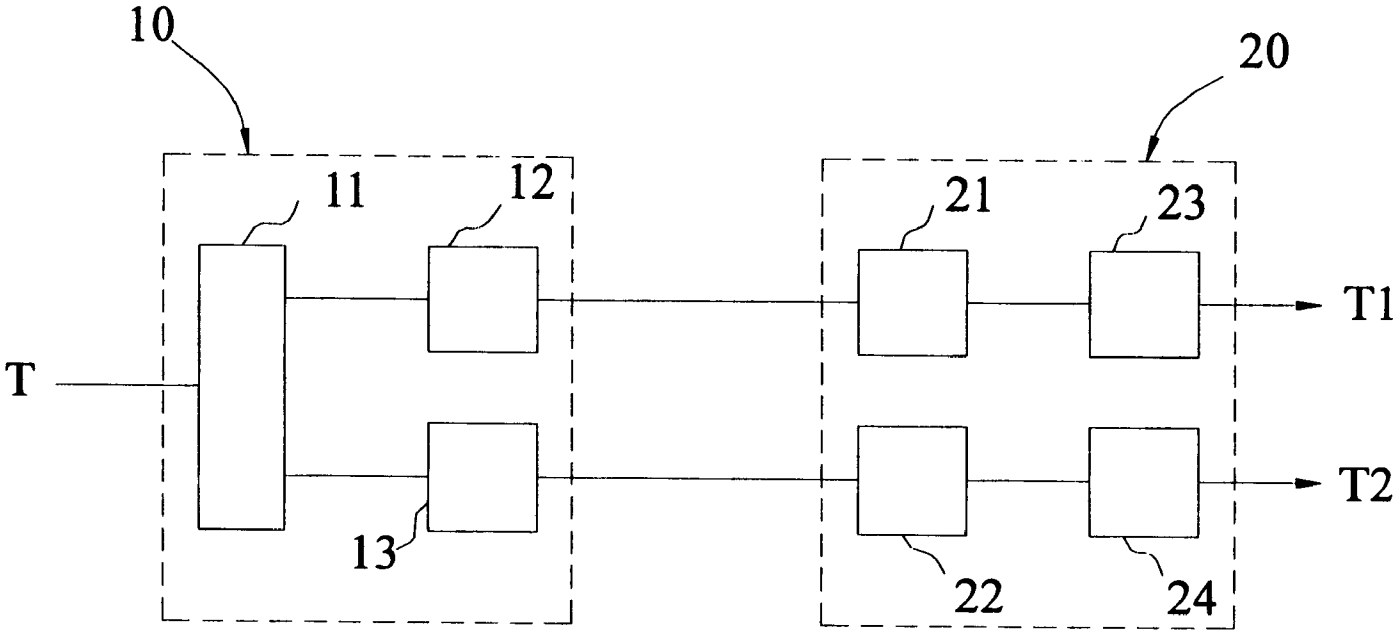
FIG. 2 is another schematic system block diagram of the disclosed driver circuit.

Please refer to FIG. 2 for a detailed explanation of the driving unit 10 and the transformer unit 20. The driving unit 10 of the disclosed driver circuit has a driving component 11, a first switching unit 12 and a second switching unit 13. The driving component 11 can be a control IC (integrated circuit). After the work period T is received, the work period T is computed according to the number of the CCFL's in the LCDM to produce a driving signal. Suppose a work period is $\pi(180°)$ and the LCDM has to sets of CCFL's, the driving component 11 produces a driving signal each $\pi/2(90°)$. The driving signal is sent to the first switching unit 12 and the second switching unit 13, which after receiving the driving signal switch the driving signal into a driving voltage and send the driving voltage to the transformer unit 20.

The transformer unit 20 contains a first amplifying unit 21, a second amplifying unit 22, a first transforming unit 23, and a second transforming unit 24. The first amplifying unit 21 and the second amplifying unit 22 can be MOSFET's (metal oxide semiconductor field effect transistor). The first amplifying unit 21 is connected to the first switching unit 12 for amplifying the driving voltage and transmitting it to the first transforming unit 23. The second amplifying unit 22 is connected to the second switching unit 13 also for amplifying the driving voltage and transmitting it to the second transforming unit 24. The first transforming unit 23 and the second transforming unit 24 are transformers. After the first transforming unit 23 receives the driving voltage amplified by the first amplifying unit, the driving voltage is transformed and sent to one set of the CCFL's. After the second transforming unit 24 receives the driving voltage amplified by the second amplifying unit, the driving voltage is transformed and sent to the other set of the CCFL's.

Figure 3:
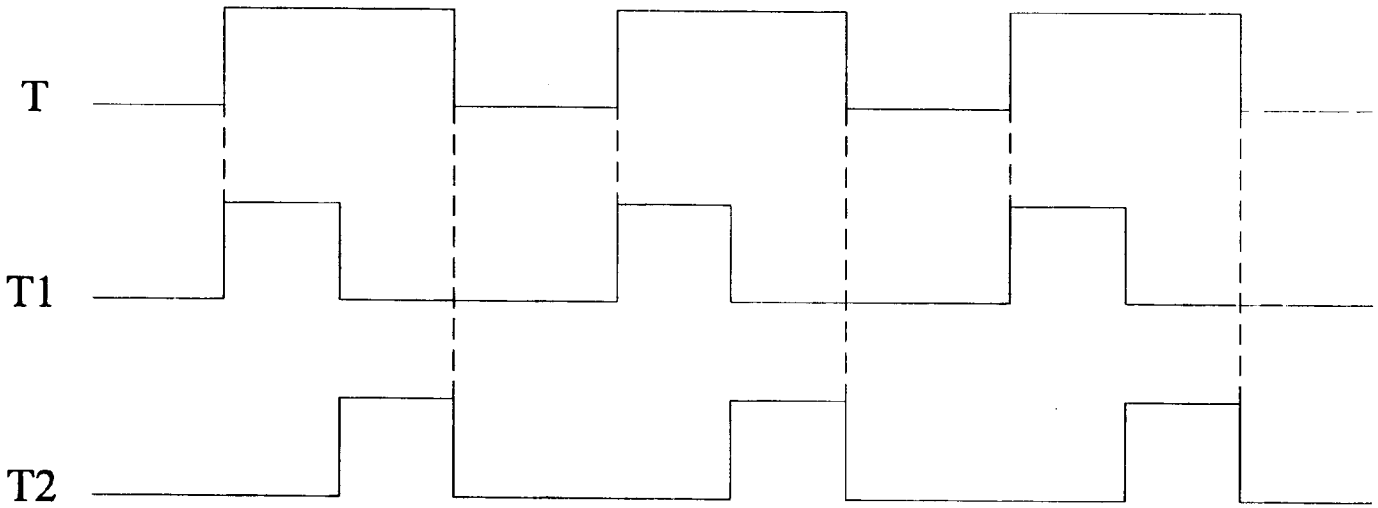
FIG. 3 is a signal timing diagram of the disclosed driver circuit.

With reference to FIG. 3, the timing of driving the CCFL's according to the above embodiment is explained as follows. To lower the power consumption, the disclosed driver circuit is designed to have an asynchronous driving means. Suppose the LCDM has two sets of CCFL's. After receiving the work period T, the driving unit 11 sends out two driving signals according to the number of CCFL's within the work period T, providing a first work voltage T1 and a second work voltage T2. The production time of the first work voltage and that of the second work voltage are separated to achieve asynchronous driving.

In summary, the disclosed driver circuit uses asynchronous driving within a work period. Its advantage is that the power consumption of the LCDM can be largely lowered during operations. Furthermore, the invention only requires a driving component to produce driving signals. In comparison with the prior art where each set of CCFL needs an individual driving component, the invention needs fewer components and thus saves the cost. The invention further minimizes the space use of the circuit, which is convenient for circuit designs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A driver circuit for LCDM (liquid crystal display module) that is installed with a plurality of lamps to be driven within a work period, the driver circuit comprising:

a driving unit, which receives the work period, performs operations on the work period and, after the operations being completed, sends a plurality of driving voltages in an asynchronous way to an output terminal within the work period; and a transformer unit, which is connected to the driving unit for receiving, amplifying and transforming the plurality of driving voltages and transmitting them to the plurality of lamps, wherein the driving unit further comprises:

a driving unit, which receives the work period, performs operations on the work period, and, after the operations being completed, produces a plurality of driving signals in an asynchronous way to a first output terminal and a second output terminal;

a first switching unit, which is connected to the first output terminal for converting the driving signal into the driving voltage to be sent to the first output terminal; and a second switching unit, which is connected to the second output terminal for converting the driving signal into the driving voltage to be sent to the second output terminal.

2. The driver circuit of claim 1, wherein the transformer unit further comprises:

a first amplifying unit, which is connected to the first switching unit for amplifying and transmitting the driving voltage to the first output terminal;

a second amplifying unit, which is connected to the second switching unit for amplifying and transmitting the driving voltage to the second output terminal;

a first transforming unit, which is connected to the first amplifying unit for transforming and transmitting the driving voltage to the lamps; and a second transforming unit, which is connected to the second amplifying unit for transforming and transmitting the driving voltage to the lamps.

3. The driver circuit of claim 2, wherein the first amplifying unit is an MOSFET (metal oxide semiconductor field effect transistor).

4. The driver circuit of claim 2, wherein the second amplifying unit is an MOSFET (metal oxide semiconductor field effect transistor).

5. The driver circuit of claim 2, wherein the first transforming unit is a transformer.

6. The driver circuit of claim 2, where in the second transforming unit is a transformer.

7. The driver circuit of claim 1, wherein the lamp is a CCFL (cold cathode fluorescent lamp).

8. The driver circuit of claim 1, wherein the driving unit is a control IC (integrated circuit).

* * * * *